US012415693B2

(12) United States Patent
Nishimura et al.

(10) Patent No.: US 12,415,693 B2
(45) Date of Patent: Sep. 16, 2025

(54) SHEET CONVEYANCE APPARATUS AND IMAGE FORMING APPARATUS INCLUDING THE SAME

(71) Applicant: KYOCERA Document Solutions Inc., Osaka (JP)

(72) Inventors: Takuya Nishimura, Osaka (JP); Yasunori Ueno, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 228 days.

(21) Appl. No.: 18/248,408

(22) PCT Filed: Oct. 6, 2021

(86) PCT No.: PCT/JP2021/036985
§ 371 (c)(1),
(2) Date: Apr. 10, 2023

(87) PCT Pub. No.: WO2022/080210
PCT Pub. Date: Apr. 21, 2022

(65) Prior Publication Data

US 2023/0356969 A1 Nov. 9, 2023

(30) Foreign Application Priority Data

Oct. 14, 2020 (JP) ..... 2020-173227

(51) Int. Cl.
*B65H 5/06* (2006.01)
*B65H 5/36* (2006.01)

(52) U.S. Cl.
CPC ..... *B65H 5/062* (2013.01); *B65H 5/36* (2013.01); *B65H 2301/4455* (2013.01);
(Continued)

(58) Field of Classification Search
CPC . B65H 29/60; B65H 2402/31; B65H 2601/11
See application file for complete search history.

(56) References Cited

U.S. PATENT DOCUMENTS 7,168,701 B2 * 1/2007 Isaka ..... H04N 1/00538 271/301
2019/0294099 A1 9/2019 Tabuchi

FOREIGN PATENT DOCUMENTS

JP 2000-153934 A 6/2000
JP 4979471 B2 * 7/2012
(Continued)

OTHER PUBLICATIONS

Translation JP '925 (Year: 2025).*
Translation JP '471 (Year: 2025).*

*Primary Examiner* — Howard J Sanders
(74) *Attorney, Agent, or Firm* — Studebaker Brackett PLLC

(57) ABSTRACT

A sheet conveyance apparatus (26) includes: a first conveyance unit (70*a*), a second conveyance unit (70*b*) disposed below the first conveyance unit (70*a*) and including a second upper conveyance guide (75) and a second lower conveyance guide (77), and an apparatus main body, wherein the second conveyance unit (70*b*) can be drawn out to a front side of the apparatus main body along a front-and-rear direction perpendicular to a sheet conveyance direction, the second upper conveyance guide (75) includes: a guide main body part (75*b*) turnable upward and downward with respect to the apparatus main body with a rear end edge as a turning support shaft and a front end edge as a turning end; and a movable guide part (75*c*) coupled to the turning end of the guide main body part (75*b*) via a hinge part (75*d*) in a turnable manner.

6 Claims, 6 Drawing Sheets

(52) U.S. Cl.
CPC ..... *B65H 2402/31* (2013.01); *B65H 2801/06* (2013.01); *B65H 2801/27* (2013.01)

(56) References Cited

FOREIGN PATENT DOCUMENTS

| | | | | |
|---|---|---|---|---|
| JP | 2019060925 | A | * | 4/2019 |
| JP | 2019-167226 | A | | 10/2019 |

* cited by examiner

SHEET CONVEYANCE APPARATUS AND IMAGE FORMING APPARATUS INCLUDING THE SAME

TECHNICAL FIELD

The present invention relates to a sheet conveyance apparatus which conveys a sheet and an image forming system including the sheet conveyance apparatus.

BACKGROUND

Conventionally, a sheet post-processing apparatus is known, which can perform a binding processing in which a plurality of sheets on which an image is formed by an image forming apparatus such as a copying machine or a printer are stacked and then the stack of sheets is stapled with staples, a punching processing in which holes are formed in the stack of sheets by a punching apparatus, and the like. The above-described sheet post-processing apparatus is utilized when performing the post-processing such as the binding processing for a relatively large number of sheets.

As a method for connecting the image forming apparatus and the sheet post-processing apparatus, there is proposed a method for disposing a relay conveyance apparatus between the image forming apparatus and the sheet post-processing apparatus. For example, Patent Document 1 discloses a relay conveyance device including at least two inversion paths which pass at least two inversion units, a first branching part branching to at least one of the two inversion paths, and a first merging part merging at least the two inversion paths. The first branching part and the first merging part are controlled so as to alternately switch the inversion paths and to convey the sheet, and the inter-sheet time of the sheet passing through the first merging part is measured and then the conveyance of sheet in at least the two inversion paths is controlled such that the inter-sheet times becomes uniform.

As in the relay conveyance apparatus described in Patent Document 1, the conveyance paths on which the sheet stop position and the processing apparatus are provided are provided, and the distances between the branching part and the merging part on the conveyance paths are set to equal, so that the constant inter-sheet time can be maintained before branching and after merging without requiring complicated control.

By the way, in a configuration including a plurality of conveyance units disposed in the upper-and-lower direction as disclosed in Patent Document 1, it is necessary to draw out the conveyance unit forward from the relay conveyance apparatus when the sheet jamming occurred in the lower conveyance unit is treated. At this time, in order to smoothly carry out the treatment of the sheet jamming, it is necessary to draw out the unit at least over the width of the conveyance path (the sheet width), then to open and close the conveyance guide, and then remove the sheet. Therefore, there is a problem that it is necessary to leave a large space in front of the relay conveyance apparatus, and that when there is no space, the user has to move to a position where he does not interfere with the drawing of the conveyance unit.

Patent Document 2 discloses a relay conveyance apparatus including an opening/closing cover for treating the sheet jamming whose one end side is supported by a supporting member, a first hinge part which supports the opening/closing cover so as to be turnable upward and downward at the upper end side of the supporting member, and a second hinge part which supports the supporting member to a base member so as to be turnable upward and downward at the lower end side of the supporting member. By the two-state hinge function of the supporting member, the posture of the opening/closing cover after opening is substantially parallel to that before opening, and a jam treatment space having a uniform height is formed below the lower surface of the opening/closing cover.

PRIOR ART DOCUMENTS

Patent Document

[Patent Document 1] Japanese Patent Laid-Open 2019-167226

[Patent Document 2] Japanese Patent Laid-Open 2000-153934

SUMMARY OF THE INVENTION

Problems to be Solved by the Invention

In the configuration disclosed in Patent Document 2, the opening/closing cover is displaced upward in a state in which the posture of the opening/closing cover after opening is maintained substantially parallel to the posture before opening. In the configuration in which the conveyance units are disposed in the upper-and-lower direction, since there is no space for displacing the opening/closing cover upward, the same drawing-out operation of the conveyance unit as in the prior art is required.

In view of the above problems, it is an object of the present invention to provide a sheet conveyance apparatus including two or more conveyance paths disposed in parallel in the upper-and-lower direction and capable of easily removing a sheet stopped in the lower conveyance path, and an image forming system including the same.

Means of Solving the Problems

In order to achieve the above purpose, a sheet conveyance apparatus of the present invention includes: a first conveyance unit which includes a first upper conveyance guide facing an upper surface of a sheet, a first lower conveyance guide facing a lower surface of the sheet and a conveyance member conveying the sheet along the first upper conveyance guide and the first lower conveyance guide, and forms a first sheet conveyance path; a second conveyance unit which is disposed below the first conveyance unit in parallel, includes a second upper conveyance guide facing the upper surface of the sheet, a second lower conveyance guide facing the lower surface of the sheet and a conveyance member conveying the sheet along the second upper conveyance guide and the second lower conveyance guide, and forms a second sheet conveyance path; and an apparatus main body in which the first conveyance unit and the second conveyance unit are housed, wherein the second conveyance unit can be drawn out horizontally to a front side of the apparatus main body along a front-and-rear direction perpendicular to a sheet conveyance direction with respect to the apparatus main body, the second upper conveyance guide of the second conveyance unit includes: a guide main body part turnable upward and downward with respect to the apparatus main body with a rear end edge as a turning support shaft and a front end edge as a turning end; and a movable guide part coupled to the turning end of the guide main body part via a hinge part in a turnable manner.

Effects of the Invention

According to the first configuration of the present invention, the movable guide part of the upper conveyance guide of the lower conveyance unit is turned upward around the hinge portion, so that interference with the upper conveyance unit can be avoided, and the upper conveyance guide can be smoothly opened and closed over a wide range during the sheet jamming treatment work. Further, the drawing amount of the lower conveyance unit can be reduced as compared with the conventional one, and it is not necessary to leave a large space for drawing out the lower conveyance unit in front of the sheet conveyance apparatus. Further, since the movement of the user at the time of the draw-out operation of the lower conveyance unit is suppressed, the workability of the sheet jamming treatment is improved.

EMBODIMENT FOR CARRYING OUT THE INVENTION

Figure 1:
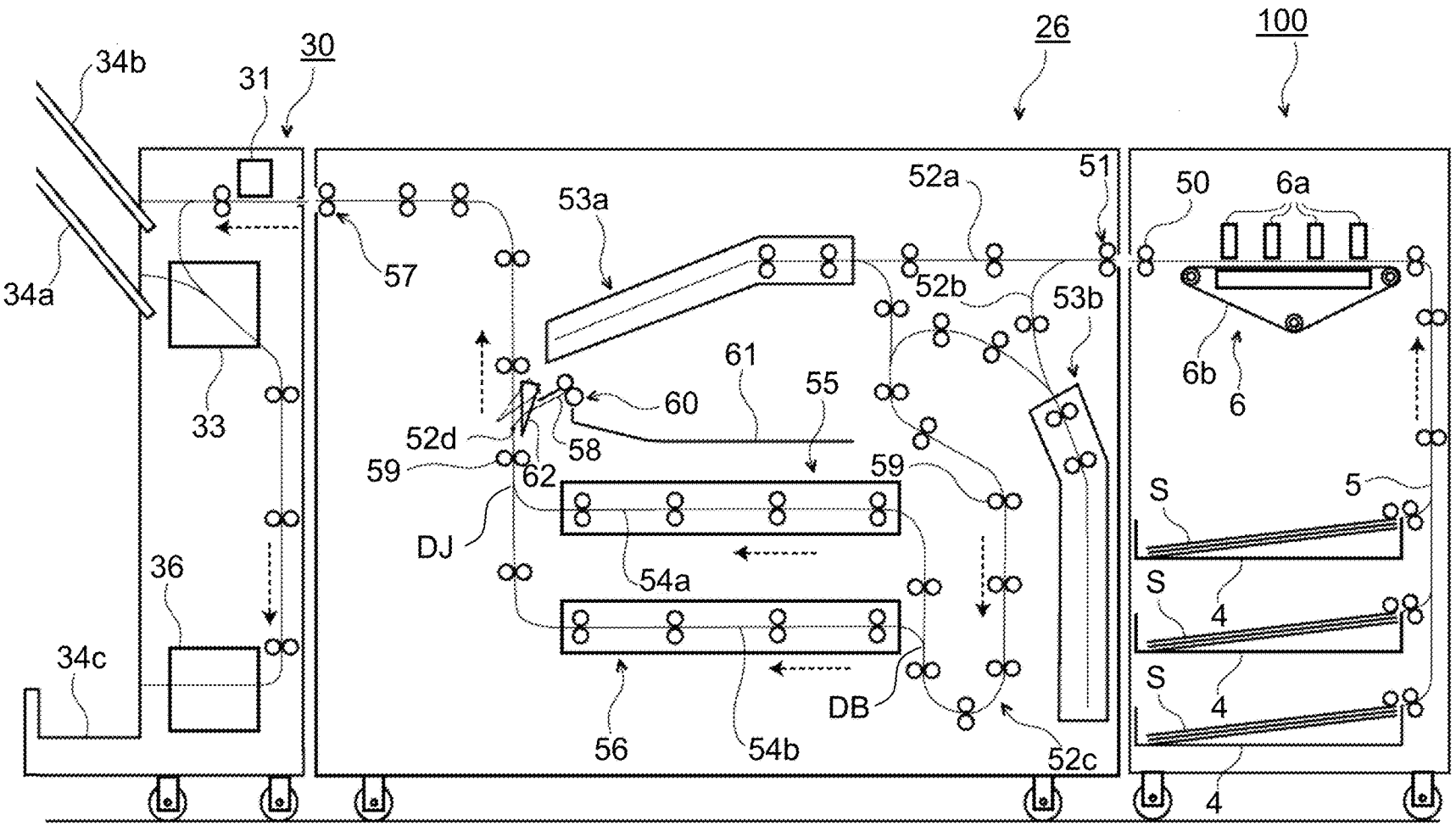
FIG. 1 is a view schematically showing an inner structure of an image forming system 200 including a relay conveyance apparatus 26 that is an example of a sheet conveyance apparatus according to the present invention.

Hereinafter, with reference to the drawings, one embodiment of the present invention will be described. FIG. 1 is a view schematically showing an inner structure of an image forming system 200 provided with a relay conveyance apparatus 26 as an example of a sheet conveyance apparatus of the present invention. With reference to FIG. 1, the image forming system 200 including an image forming apparatus 100, the relay conveyance apparatus 26, and a sheet post-processing apparatus 30 will be described.

The image forming apparatus 100 is an inkjet recording type printer, and includes a sheet feeding part 4 disposed in the lower portion of the image forming apparatus 100, a sheet conveyance part 5 which feeds the sheet S stored in the sheet feeding part 4 to an image forming part 6, and the image forming part 6 disposed above the sheet feeding part 4.

The image forming part 6 includes a print head 6*a* and a conveyance part 6*b* disposed so as to face the print head 6*a*. The conveying part 6*a* includes an endless conveyance belt wound around a plurality of rollers including a drive roller. The sheet S conveyed by the sheet conveyance part 5 passes under the print head 6*a* in a state of being attracted and held by the conveyance belt 7*a* by a sheet suction part provided in the inside space of the conveyance belt 7*a*. The sheet S on which the predetermined image is recorded by the image forming part 6 is discharged from a discharge rollers pair 50 and carried into the relay conveyance apparatus 26.

The relay conveyance apparatus 26 is disposed independently between the image forming apparatus 100 and the sheet post-processing apparatus 30, and relays the sheet S discharged from the image forming apparatus 100 to the sheet post-processing apparatus 30. The relay conveyance apparatus 26 performs an inversion processing in which the sheet S on which the image is recorded by the image forming apparatus 100 is turned upside down and a drying processing in which the ink on the sheet S is dried. As shown in FIG. 1, the sheet S carried in from the relay carry-in port 51 of the relay conveyance apparatus 26 passes through a first conveyance path 52*a* and is conveyed to a first inversion conveyance path 53*a*. The first inversion conveyance path 53*a* turns the sheet S upside down by switching (switching back) the conveyance direction of the sheet S conveyed from the first conveyance path 52*a*.

A second conveyance path 52*b* branched from the first conveyance path 52*a* is provided, and the sheet S passed through the second conveyance path 52*b* is conveyed to a second inversion conveyance path 53*b*. The second inversion conveyance path 53*b* turns the sheet S upside down by switching (switching back) the conveyance direction of the sheet S conveyed from the second conveyance path 52*b*.

The sheet S which is turned upside down by the first inversion conveyance path 53*a* or the second inversion conveyance path 53*b* is conveyed to a third conveyance path 52*c*. The sheet S is conveyed to a first bypass conveyance path 54*c* and a second bypass conveyance path 54*b* branched from a third conveyance path 52*c* at the branching part DB. The first bypass conveyance path 54*a* and the second bypass conveyance path 54*b* are provided with a first correction unit 55 and a second correction unit 56, respectively. The first correction unit 55 and the second correction unit 56 correct the position of the sheet S in the width direction of the sheet S (the direction perpendicular to the paper plane of FIG. 1).

In the first bypass conveyance path 54*a* and the second bypass conveyance path 54*b*, a distance from the branching part DB to the merging part DJ is equal. Further, a distance from the branching part DB to the sheet stop position (the horizontal portion in FIG. 1) is equal to a conveyance interval of the sheets S (an interval between the sheets). Therefore, for example, by stopping the first sheet S turned upside down in the first inversion conveyance path 53*a* in the second bypass conveyance path 54*b* and stopping the second sheet S turned upside down in the second inversion conveyance path 53*b* in the first bypass conveyance path 54*a*, the stopped sheet S can be conveyed again while maintaining the interval between the sheets. That is, before one of the first inversion conveyance path 53*a* and the second inversion conveyance path 53*b* completes the turning operation of the first sheet S, the turning operation of the second sheet S can be started in the other of the first inversion conveyance path 53*a* and the second inversion conveyance path 53*b*.

In the same manner, by alternately carrying the sheet S into the first correction unit 55 and the second correction unit 56 disposed on the first bypass conveyance path 54*a* and the second bypass conveyance path 54*b*, respectively, before one of the first correction unit 55 and the second correction unit 56 completes the position correcting operation of the first sheet S, the position correcting operation of the second sheet S can be started in the other of the first correction unit 55 and the second correction unit 56.

As a result, the waiting time for the turning and the position correcting of the sheet S can be shortened, and the processing efficiency (a number of sheets processed per unit time) of the sheet S by the relay conveyance apparatus 26 can be enhanced.

The sheet S passed through the first bypass conveyance path 54*a* and the second bypass conveyance path 54*b* is conveyed to a fourth conveyance path 52*d* at the merging part DJ. The sheet S passes through the fourth conveyance path 52*d*, and is carried into the sheet post-processing apparatus 30 through a relay carry-out port 57.

In addition, an in-body discharge conveyance path 58 branched from the fourth conveyance path 52*d* is provided, and the sheet S passed through the in-body discharge conveyance path 58 is discharged to a collection tray 61 by an in-body discharge rollers pair 60. When a sheet jamming occurs in the sheet post-processing apparatus 30, the conveyance path is switched by a third branch guide 62 provided at a branching part of the fourth conveyance path 52*d* and the in-body discharge conveyance path 58, and the next sheet S existing in the relay conveyance apparatus 26 is discharged to the collection tray 61 via the in-body discharge conveyance path 58 and the in-body discharge rollers pair 60.

A conveyance rollers pair 59 (conveyance members) for conveying the sheet S is disposed in place on the first conveyance path 52*a* to the fourth conveyance path 52*d*, the first bypass conveyance path 54*a*, the second bypass conveyance path 54*b*, and the in-body discharge conveyance path 58.

Inside the sheet post-processing apparatus 30, there are provided a punching apparatus 31 which punches the carried-in sheet S, a stapler 33 which stacks a plurality of the carried-in sheets S, aligns the ends of the stack of the sheets S, and binds them with staples, and a binding/folding unit 36 which staples the center of the stack of sheets S and then folds it around the stapled portion to form a booklet. On the side surface of the sheet post-processing apparatus 30, there are provided a main tray 34*a* which can be lifted and lowered to a position suitable for discharging the sheet S, a sub-tray 34*b* fixed to the upper portion of the sheet post-processing apparatus 30, and a booklet tray 34*c* on which a bundle of the sheets S folded into a booklet shape by the binding/folding unit 36 is discharged.

Figure 2:
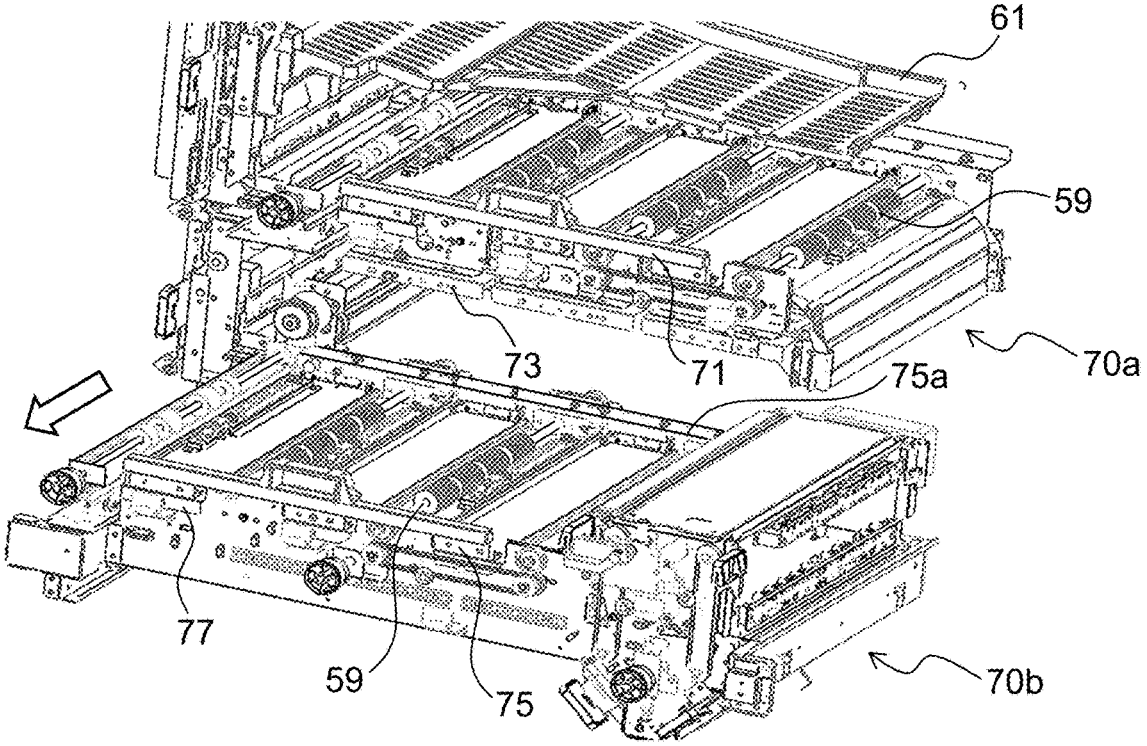
FIG. 2 is a perspective view showing a first conveyance unit 70*a* and a second conveyance unit 70*b* constituting a first bypass conveyance path 54*a* and a second bypass conveyance path 54*b* of the relay conveyance apparatus 26.

FIG. 2 is a perspective view showing a first conveyance unit 70*a* and a second conveyance unit 70*b* constituting the first bypass conveyance path 54*a* and the second bypass conveyance path 54*b*. The first conveyance unit 70*a* (an upper conveyance unit) and the second conveyance unit 70*b* (the lower conveyance unit) are disposed in parallel so as to be overlapped in the upper-and-lower direction. FIG. 2 shows a state in which the second conveyance unit 70*b* is drawn out from below the first conveyance unit 70*a* in the sheet width direction (the white arrow direction in FIG. 2) perpendicular to the conveyance direction.

The first conveyance unit 70*a* is disposed above the second conveyance unit 70*b* and below the collection tray 61, and includes a first upper conveyance guide 71 and a first lower conveyance guide 73 which face the upper and lower surfaces of the sheet S. The first upper conveyance guide 71 and the first lower conveyance guide 73 forms the conveyance surfaces (the conveyance guide) of the first bypass conveyance path 54*a* (see FIG. 1). The upper rollers constituting the conveyance rollers pairs 59 in the first bypass conveyance path 54*a* are supported by the first upper conveyance guide 71. The lower roller constituting the conveyance rollers pairs 59 are supported by the first lower conveyance guide 73.

The second conveyance unit 70*b* is disposed below the first conveyance unit 70*a*, and includes a second upper conveyance guide 75 and a second lower conveyance guide 77 which face the upper and lower surfaces of the sheet S. The second upper conveyance guide 75 and the second lower conveyance guide 77 form the conveyance surface (the conveyance guide) of the second bypass conveyance path 54*b* (see FIG. 1). The upper roller constituting the conveyance rollers pairs 59 in the second bypass conveyance path 54*a* are supported by the second upper conveyance guide 75. The lower roller constituting the conveying rollers pairs 59 are supported by the second lower conveyance guide 77.

The second upper conveyance guide 75 is supported so as to be opened and closed in the upper-and-lower direction with respect to the second lower conveyance guide 77, with one end side in the width direction perpendicular to the conveyance direction of the sheet S (the rear side of the relay conveyance apparatus 26, and the rear side of FIG. 2) as a turning support shaft 75*a* and the front side of the relay conveyance apparatus 26 (the front side in FIG. 2) opposite to the turning support shaft 75*a* as the turning side.

When the sheet S carried into the second conveyance unit 70*b* (the second bypass conveyance path 54*b*) is jammed, as shown in FIG. 2, the second conveyance unit 70*b* is drawn out from below the first conveyance unit 70*a* to the front side of the relay conveyance apparatus 26.

Figure 3:
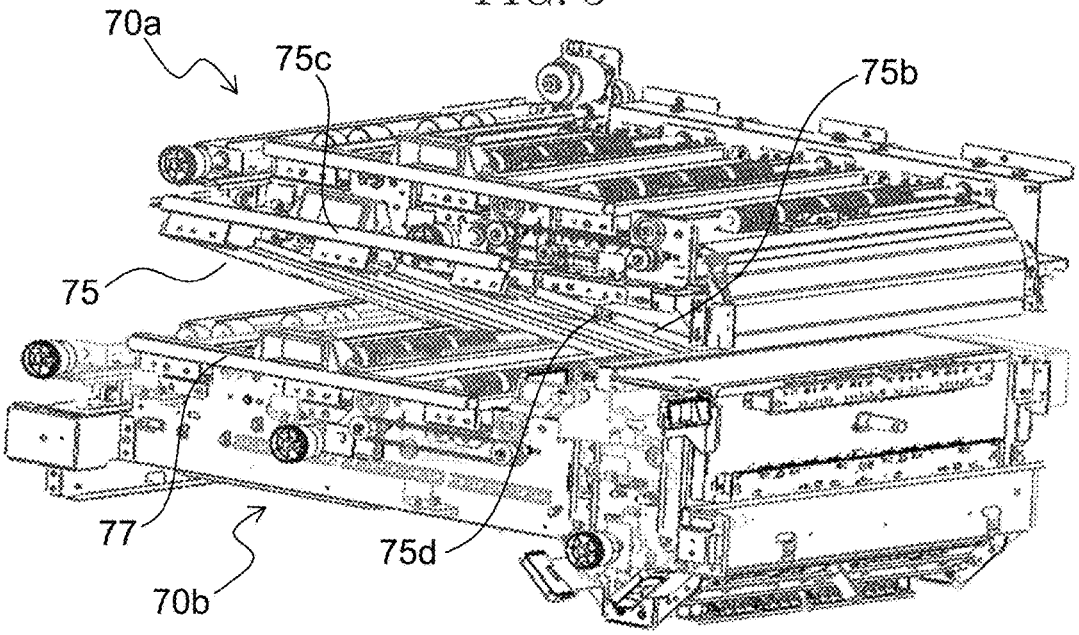
FIG. 3 is a perspective view showing a state in which a second upper conveyance guide 75 is opened from the state shown in FIG. 2.
Figure 4:
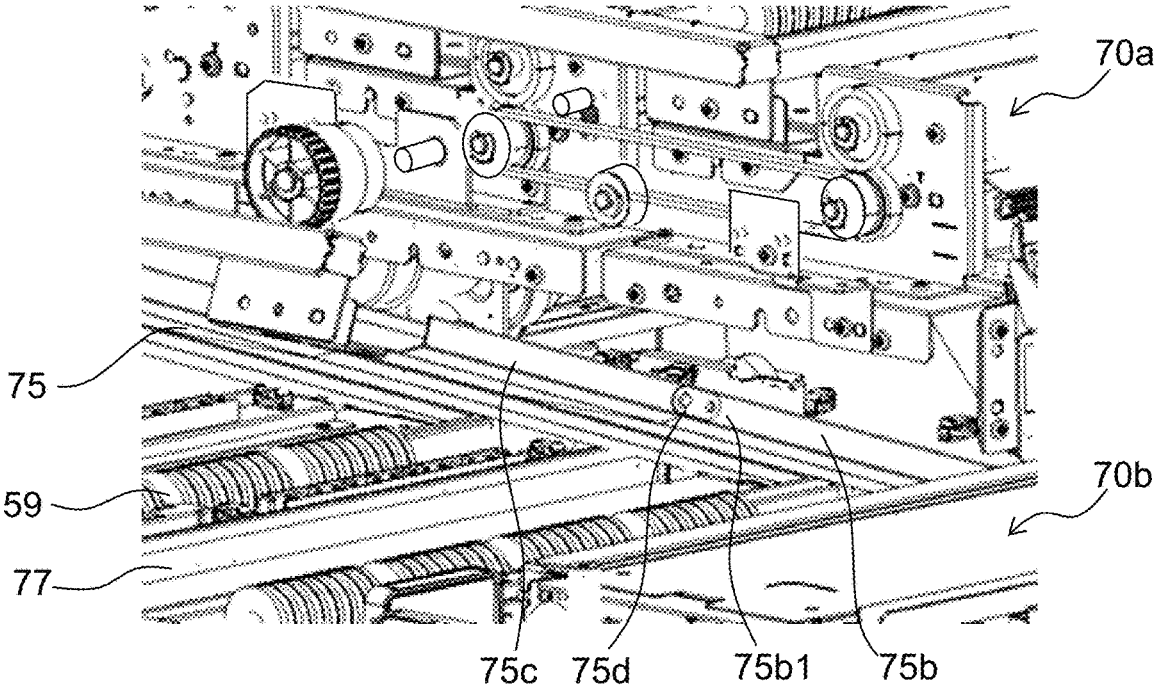
FIG. 4 is a partial enlarged view showing a hinge part 75*d* of the second upper conveyance guide 75 in FIG. 3 and its peripheral.

FIG. 3 is a perspective view showing a state in which the second upper conveyance guide 75 is opened. FIG. 4 is a partially enlarged view showing the hinge part 75*d* of the second upper conveyance guide 75 in FIG. 3 and its periphery. From the state shown in FIG. 2, when the turning end of the second upper conveyance guide 75 is turned upward to open the conveyance surfaces from the front side of the relay conveyance apparatus 26 (the left front side in FIG. 3) and the upper and lower conveyance rollers constituting the conveyance roller pair 59 separates away each other, the sheet S jammed in the second conveyance unit 70*b* can be pulled out to the front side of the relay conveyance apparatus 26 and removed Here, the first conveyance unit 70*a* is disposed above the second upper conveyance guide 75, and interferes with the first conveyance unit 70*a* when the second upper conveyance guide 75 is turned upward. Therefore, in order to open the conveyance surfaces of the second bypass conveyance path 54*b* in a wide range by increasing the turning angle of the second upper conveyance guide 75, it is necessary to increase the drawing amount of the second conveyance unit 70*b* with respect to the first conveyance unit 70*a*.

Therefore, in the present embodiment, the second upper conveyance guide 75 includes a guide main body part 75*b* and a movable guide part 75*c*. The guide main body part 75*b* has a front turning end 75*b*1 (the front end portion in FIG. 3) that can be turned upward and downward with the rear end edge on the rear side of the relay conveyance apparatus 26 as a turning support shaft 75*a* (see FIG. 2). The movable guide part 75*b* is supported by the turning end 75*b*1 of the guide main body part 75*a* via a hinge part 75*d*.

Figure 5:
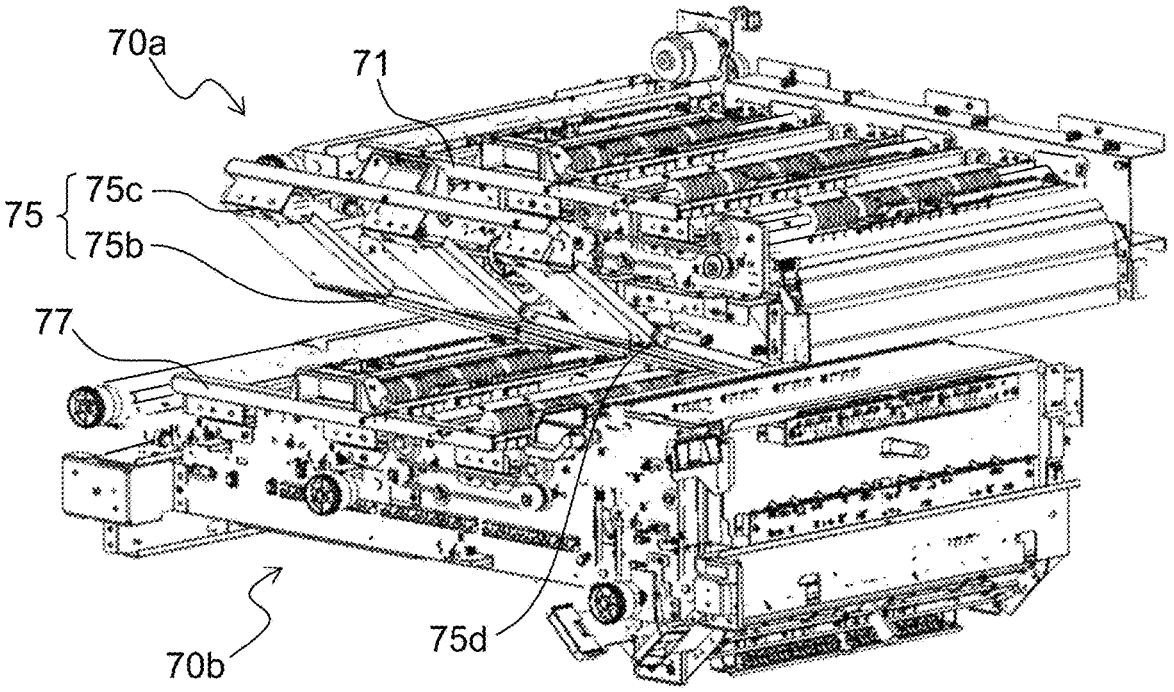
FIG. 5 is a perspective view showing a state in which a movable guide part 75*c* is turned relative to a guide main body part 75*b* from the state shown in FIG. 3.
Figure 6:
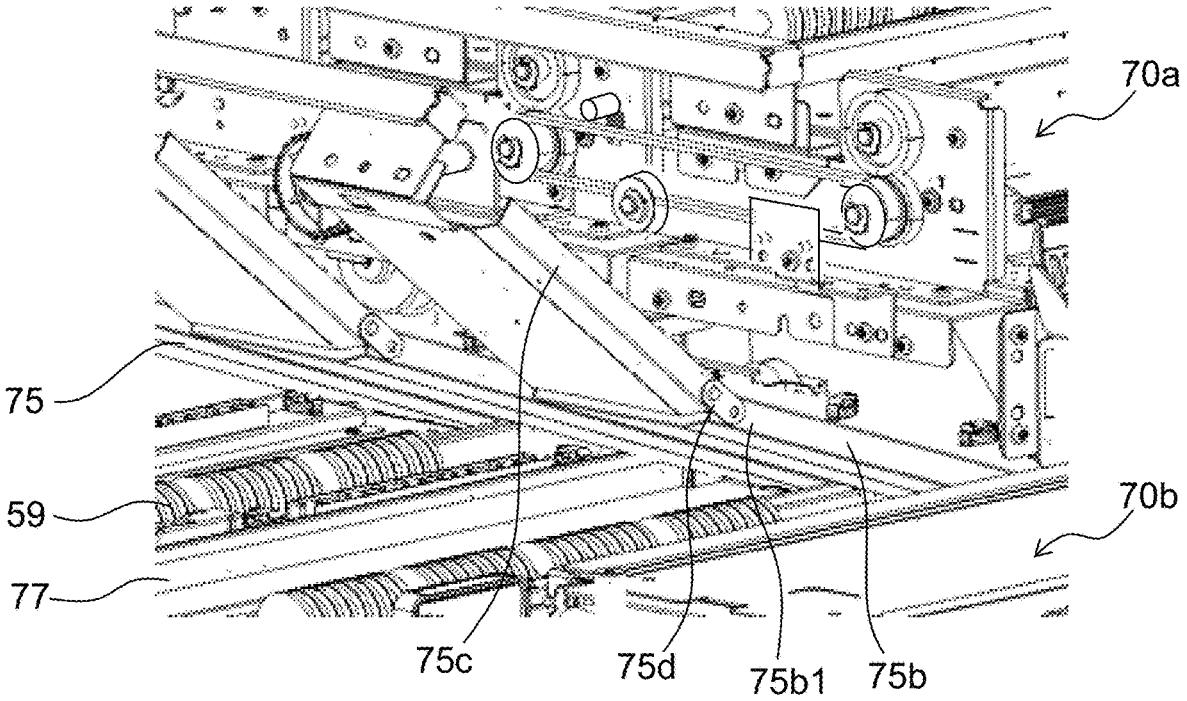
FIG. 6 is a partial enlarged view showing the hinge part 75*d* of the second upper conveyance guide 75 in FIG. 5 and its periphery.

FIG. 5 is a perspective view showing a state in which the movable guide part 75*c* is turned relative to the main guide body part 75*b* from the state shown in FIG. 3. FIG. 6 is a partially enlarged view of the hinge part 75*d* of the second upper conveyance guide 75 in FIG. 5 and its periphery. As shown in FIG. 5 and FIG. 6, the movable guide part 75*c* of the second upper conveyance guide 75 is turned upward around the hinge part 75*d* to avoid interference with the first conveyance unit 70*a*, and the second upper conveyance guide 75 can be opened and closed smoothly and in a wide range during the sheet jamming treatment.

In addition, the drawing amount of the second conveyance unit 70*b* can be reduced to about ½ to ⅓ of the conventional amount, and it is not necessary to leave a large space for drawing the second conveyance unit 70*b* in front of the relay conveyance apparatus 26. Further, since the movement of the user at the time of the drawing operation of the second conveyance unit 70*a* is also suppressed, the workability of the sheet jamming treatment is improved.

If the hinge part 75*d* is positioned on the rear side (the inside) of the front side end (the left front side in FIG. 4) of the first conveyance unit 70*a* in a state where the second conveyance unit 70*b* is drawn out, it becomes difficult to turn the movable guide part 75*c*. In order to smoothly avoid interference with the first conveyance unit 70*a* owing to the turning of the movable guide part 75*c*, it is preferable that the hinge part 75*d* is located on the front side (the outside) of the front end edge of the first conveyance unit 70*a* in a state where the second conveyance unit 70*b* is drawn out.

Figure 7:
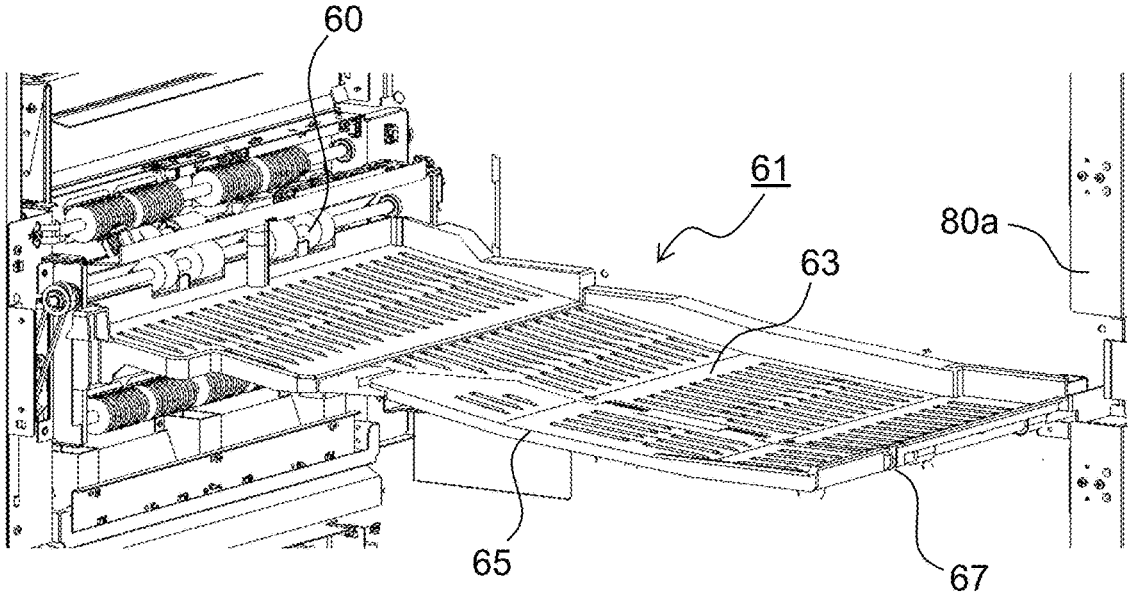
FIG. 7 is a perspective view showing a collection tray 61 provided inside the relay conveyance apparatus 26.

FIG. 7 is a perspective view showing the collection tray 61 provided inside the relay conveyance apparatus 26. The collection tray 61 has a tray body part 63 and a tray movable part 65. The tray body part 63 is fixed to the rear frame 80*a* of the relay conveyance apparatus 26. The tray movable part 65 is supported by the front side (the front side in FIG. 7) of the tray body part 63 via a hinge part 67 in a turnable manner.

Figure 8:
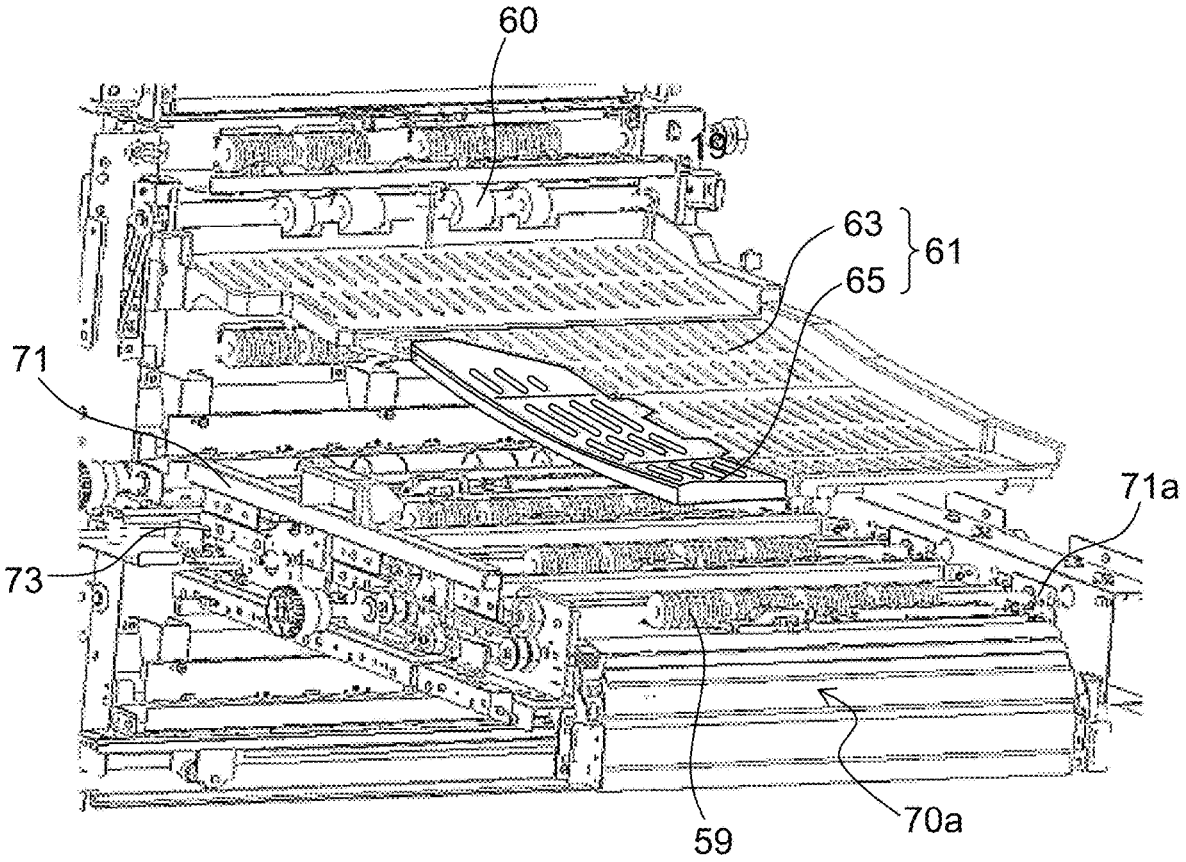
FIG. 8 is a perspective view showing the collection tray 61 and the first conveyance unit 70*a* in a state in which a collection tray movable part 65 is disposed in a sheet receiving position.
Figure 9:
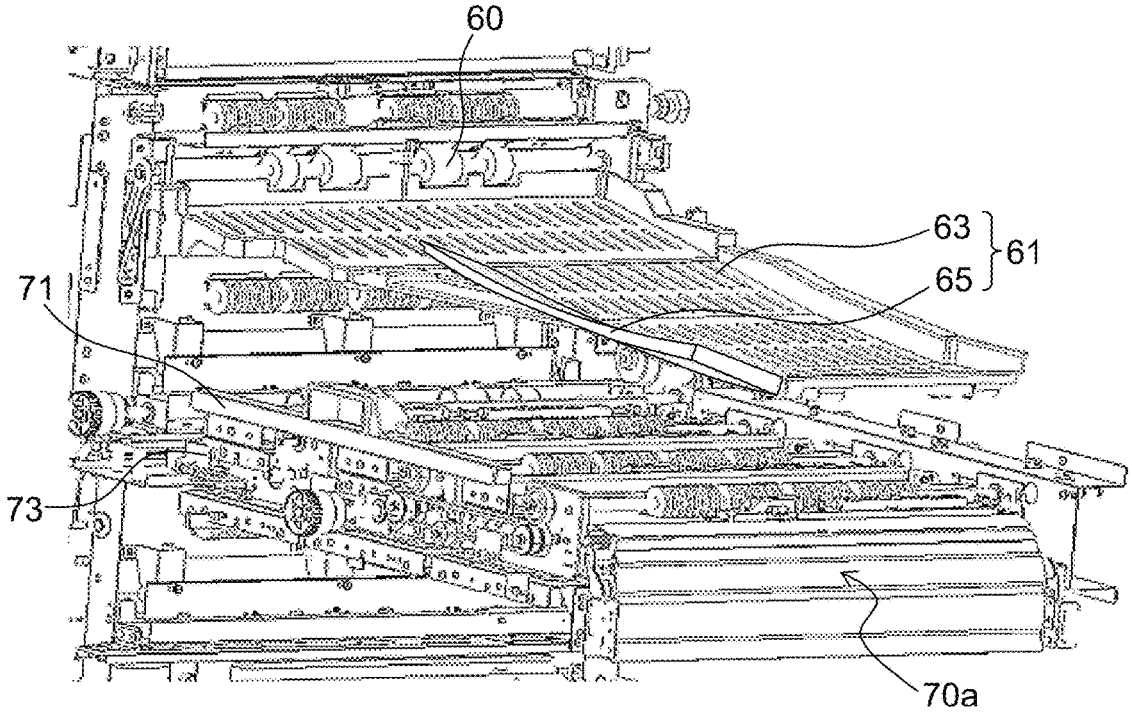
FIG. 9 is a perspective view showing the collection tray 61 and the first conveyance unit 70*a* in a state in which the collection tray movable part 65 is disposed in a retreat position.

FIG. 8 and FIG. 9 are perspective views showing the collection tray 61 and the first conveyance unit 70*a* in a state in which the tray movable part 65 is disposed in a sheet receiving position and a retreat position, respectively.

The first upper conveyance guide 71 is supported so as to be opened and closed in the upper-and-lower direction with respect to the first lower conveyance guide 73, with one end side in the width direction perpendicular to the conveyance direction of the sheet S (the back side of the relay conveyance apparatus 26, the right side of FIG. 8) as a turning support shaft 71*a* and the front side of the relay conveyance apparatus 26 (the left side in FIG. 8) opposite to the turning support shaft 71*a* as a turning end.

At a time of a normal image forming operation, as shown in FIG. 7 and FIG. 8, the tray movable part 65 is disposed in the sheet receiving position. The tray movable part 65 disposed in the sheet receiving position is on the same plane as the tray body part 63, and forms a sheet stacking surface on which the sheet S discharged from the in-body discharge rollers pair 60 is stacked, together with the tray body part 63. As shown in FIG. 9, the collection tray movable part 65 is movable to a retreat position turned upward from the sheet receiving position.

Figure 10:
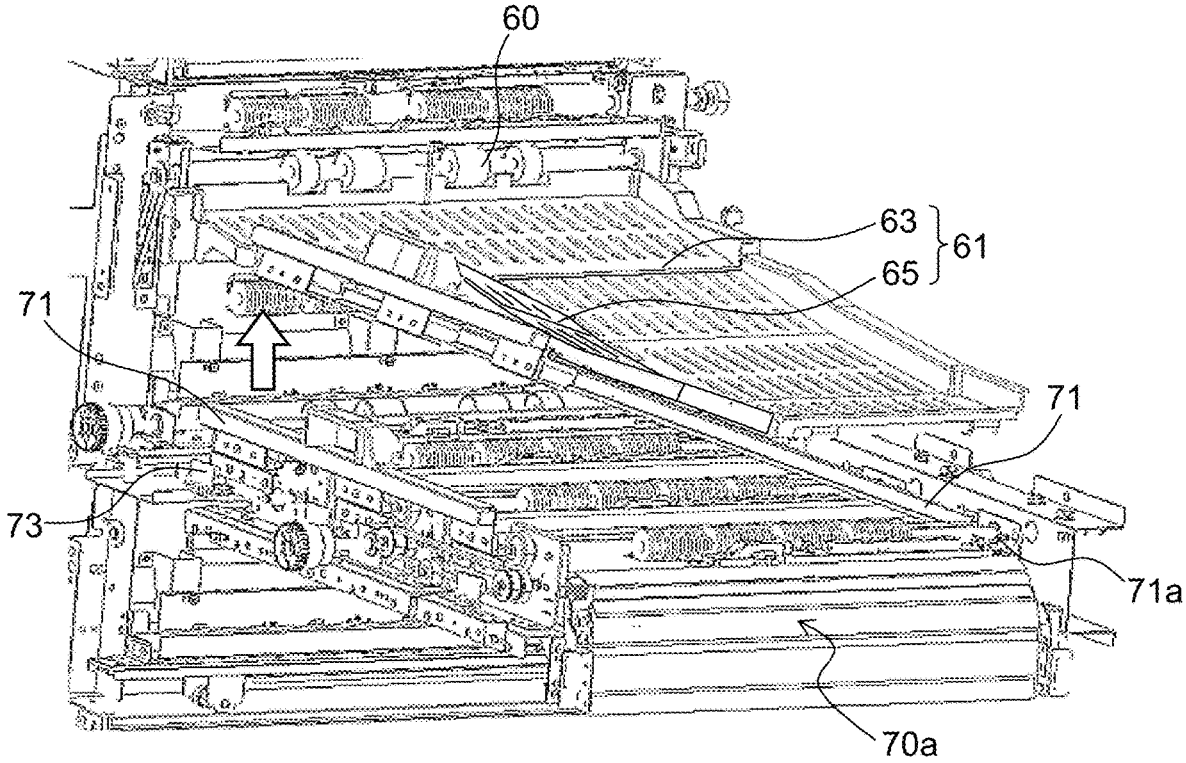
FIG. 10 is a perspective view showing the collection tray 61 and the first conveyance unit 70*a* in a state in which an upper conveyance guide 71 is opened.

FIG. 10 is a perspective view showing a state in which the first upper conveyance guide 71 is opened. When the sheet S carried in the first conveyance unit 70*a* (the first bypass conveyance path 54*a*) is jammed, the turning end of the first upper conveyance guide 71 is turned upward to open the conveyance surfaces from the front side of the relay conveyance apparatus 26 (the left side in FIG. 10), and the upper and lower conveyance rollers constituting the conveyance rollers pairs 59 are separated away each other. As a result, the jammed paper S can be pulled out to the front side of the relay conveyance apparatus 26 (the left side in FIG. 10) and removed.

As shown in FIG. 10, the tray movable part 65 is positioned just above the first upper conveyance guide 71. Therefore, when the first upper conveyance guide 71 is turned upward, the tray movable part 65 is pushed up by the first upper conveyance guide 71 and shifted from the sheet receiving position to the retreat position.

Thus, even when the collection tray 61 is disposed just above the first bypass conveyance path 54*a*, interference between the collection tray 61 and the first upper conveyance guide 71 when the first upper conveyance guide 71 is opened can be avoided, and the first upper conveyance guide 71 can be smoothly opened and closed during the sheet jamming treatment work. Accordingly, the space for disposing the collection tray 61 can be saved, and the degree of freedom of layout in the relay conveyance apparatus 26 can be increased.

In addition, the present invention is not limited to the above embodiments, and various modifications are possible without departing from the spirit of the present invention. For example, in the above embodiment, an example in which the present invention is applied to the relay conveyance apparatus 26 connected to the image forming apparatus 100 is described, but for example, the present invention can be similarly applied when the image forming apparatus 100 and the sheet post-processing apparatus 30 are provided with two conveyance paths arranged in parallel in the upper-and-lower direction.

In the above embodiment, the relay conveyance apparatus 26 including the first conveyance unit 70*a* and the second conveyance unit 70*b* disposed in parallel in the upper-and-lower direction is described, but the present invention can also be applied to the case where the relay conveyance device has three or more conveyance units disposed in parallel in the upper-and-lower direction. In this case, the upper conveyance guide of the conveyance unit other than the uppermost conveyance unit may be provided with a guide body part and a movable guide part which are connected to each other via a hinge part.

Although an inkjet printer is shown as an example of the image forming apparatus 1 in the above embodiment, it goes without saying that the image forming apparatus 1 can be applied to a copying machine, a laser printer, a facsimile machine, or the like other than the inkjet printer.

INDUSTRIAL AVAILABILITY

The present invention is applicable to a sheet conveyance apparatus for conveying a sheet. By utilizing the present invention, it is possible to provide a sheet conveying device which can easily remove a sheet stopped in a lower conveying path in a configuration having two or more conveyance paths disposed in parallel in the upper-and-lower direction.

The invention claimed is:

1. A sheet conveyance apparatus comprising:

a first conveyance unit which includes a first upper conveyance guide facing an upper surface of a sheet, a first lower conveyance guide facing a lower surface of the sheet and a conveyance member conveying the sheet along the first upper conveyance guide and the first lower conveyance guide, and forms a first sheet conveyance path;

a second conveyance unit which is disposed below the first conveyance unit in parallel, includes a second upper conveyance guide facing the upper surface of the sheet, a second lower conveyance guide facing the lower surface of the sheet and a conveyance member conveying the sheet along the second upper conveyance guide and the second lower conveyance guide, and forms a second sheet conveyance path; and an apparatus main body in which the first conveyance unit and the second conveyance unit are housed, wherein the second conveyance unit can be drawn out horizontally to a front side of the apparatus main body along a front-and-rear direction perpendicular to a sheet conveyance direction with respect to the apparatus main body, the second upper conveyance guide of the second conveyance unit includes:

a guide main body part turnable upward and downward with respect to the apparatus main body with a rear end edge as a turning support shaft and a front end edge as a turning end; and a movable guide part coupled to the turning end of the guide main body part via a hinge part in a turnable manner, and the sheet jammed in the second conveyance unit can be removed by drawing out the first conveyance unit until the hinge part of the second upper conveyance guide is positioned on a front side of the first conveyance unit and then turning the movable guide part upward.

2. The sheet conveyance apparatus according to claim 1, wherein the hinge part is positioned on a front side of a front end edge of the first conveyance unit in a state where the second conveyance unit is drawn out and the guide main body part is turned upward.

3. The sheet conveyance apparatus according to claim 1, further comprising:

a branching part provided on an upstream side of the first conveyance unit and the second conveyance unit in the sheet conveyance direction and switching a sheet conveyance path to the first conveyance unit or the second conveyance unit; and a merging part provided on a downstream side of the first conveyance unit and the second conveyance unit in the sheet conveyance direction and at which the sheet passed the first conveyance unit and the second conveyance unit is conveyed, wherein a length of a first bypass conveyance path from the branching part to the merging part through the first conveyance unit is equal to a length of a second bypass conveyance path from the branching part to the merging part through the second conveyance unit.

4. The sheet conveyance apparatus according to claim 1, wherein the first upper conveyance guide of the first conveyance unit is supported by the apparatus main body so as to be turnable upward and downward with a rear end edge as a turning support shaft, a sheet stacking tray on which the sheet is stacked is provided above the first conveyance unit, the sheet stacking tray includes a tray main body part supported by the apparatus main body and a tray movable part supported to a front side of the tray main body part in a turnable manner, and when the first upper conveyance guide of the first conveyance unit is turned upward, the tray movable part is pushed upward by the first upper conveyance guide so as to be retreated upward.

5. An image forming system comprising:

the sheet conveyance apparatus according to claim 1; and an image forming apparatus coupled to an upstream side of the sheet conveyance apparatus in the sheet conveyance direction and forming an image on the sheet.

6. The image forming system according to claim 5 further comprising:

a sheet post-processing apparatus coupled to a downstream side of the sheet conveyance apparatus in the sheet conveyance direction and performing a predetermined post-processing on the sheet.

* * * * *